US009611648B1

(12) United States Patent
Fiecke

(10) Patent No.: US 9,611,648 B1
(45) Date of Patent: Apr. 4, 2017

(54) HINGED CHUTE AND CONNECTOR FOR A DOWNSPOUT

(71) Applicant: John Fiecke, Toledo, WA (US)

(72) Inventor: John Fiecke, Toledo, WA (US)

( * ) Notice: Subject to any disclaimer, the term of this patent is extended or adjusted under 35 U.S.C. 154(b) by 0 days.

(21) Appl. No.: 14/923,624

(22) Filed: Oct. 27, 2015

(51) Int. Cl.
*E04D 13/08* (2006.01)

(52) U.S. Cl.
CPC ..... *E04D 13/08* (2013.01); *E04D 2013/0813* (2013.01); *E04D 2013/0833* (2013.01); *Y10T 137/8807* (2015.04)

(58) Field of Classification Search
CPC ..... E04D 13/08; Y10T 137/8807
USPC ..... 137/615; 52/16
See application file for complete search history.

(56) References Cited

U.S. PATENT DOCUMENTS

| | | | | |
|---|---|---|---|---|
| 2,975,805 | A | 3/1961 | Horn | |
| 3,375,851 | A | 4/1968 | Henry | |
| 4,270,572 | A | 6/1981 | Jarzynka | |
| 5,014,745 | A | 5/1991 | Watt | |
| 5,358,006 | A | 10/1994 | Sweers | |
| 5,358,007 | A * | 10/1994 | Carlberg | E03F 1/002 137/561 A |
| 5,452,743 | A | 9/1995 | Rortvedt | |
| 5,511,829 | A | 4/1996 | Sicotte | |
| 5,658,092 | A * | 8/1997 | Sweers | E03F 1/002 137/615 |
| 5,735,085 | A | 4/1998 | Denooy | |
| 6,827,103 | B2 * | 12/2004 | Cheremshynski et al. | E04D 13/08 137/615 |
| 6,880,295 | B2 * | 4/2005 | Frey | E04D 13/08 137/615 |
| 8,322,083 | B1 | 12/2012 | Kessler | |
| 2007/0204522 | A1 | 9/2007 | Tredennick | |

* cited by examiner

*Primary Examiner* — Kevin Lee
(74) *Attorney, Agent, or Firm* — Kyle A. Fletcher, Esq.

(57) ABSTRACT

The hinged chute and connector for a downspout is a device that is adapted to attach to a bottom end of a downspout. Moreover, the hinged chute is pivotably engaged with respect to the connector. The connector is affixed to the bottom end of the downspout. The hinged chute is able to rotate down when in use, and rotate up when not in use. A strap is used to encircle both the downspout and the hinged chute in an up position when the hinged chute is not in use. The hinged chute pivots with respect to the connector via a rod and a wing nut. The hinged chute is able to rotate down to an in-use position when rainwater is delivered via the downspout.

10 Claims, 3 Drawing Sheets

HINGED CHUTE AND CONNECTOR FOR A DOWNSPOUT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of downspouts, more specifically, a device that is adapted to connect to a downspout, and which is able to rotate upwardly when not in use.

SUMMARY OF INVENTION

The hinged chute and connector for a downspout is a device that is adapted to attach to a bottom end of a downspout. Moreover, the hinged chute is pivotably engaged with respect to the connector. The connector is affixed to the bottom end of the downspout. The hinged chute is able to rotate down when in use, and rotate up when not in use. A strap is used to encircle both the downspout and the hinged chute in an up position when the hinged chute is not in use. The hinged chute pivots with respect to the connector via a rod and a wing nut. The hinged chute is able to rotate down to an in-use position when rainwater is delivered via the downspout.

These together with additional objects, features and advantages of the hinged chute and connector for a downspout will be readily apparent to those of ordinary skill in the art upon reading the following detailed description of the presently preferred, but nonetheless illustrative, embodiments when taken in conjunction with the accompanying drawings.

In this respect, before explaining the current embodiments of the hinged chute and connector for a downspout in detail, it is to be understood that the hinged chute and connector for a downspout is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hinged chute and connector for a downspout.

It is therefore important that the claims be regarded as including such equivalent construction insofar as they do not depart from the spirit and scope of the hinged chute and connector for a downspout. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
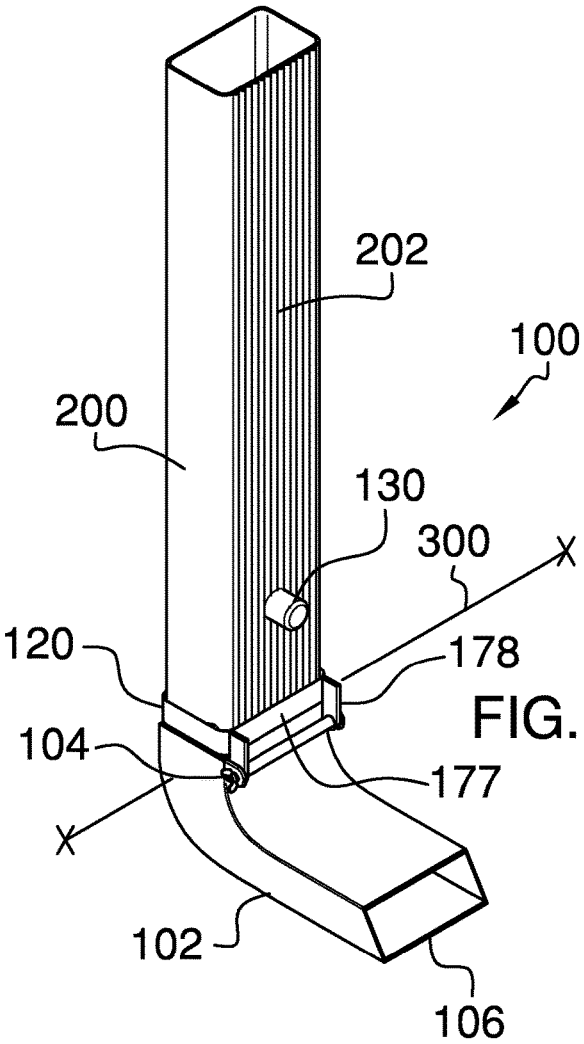
FIG. 1 is a perspective view of an embodiment of the disclosure.
Figure 2:
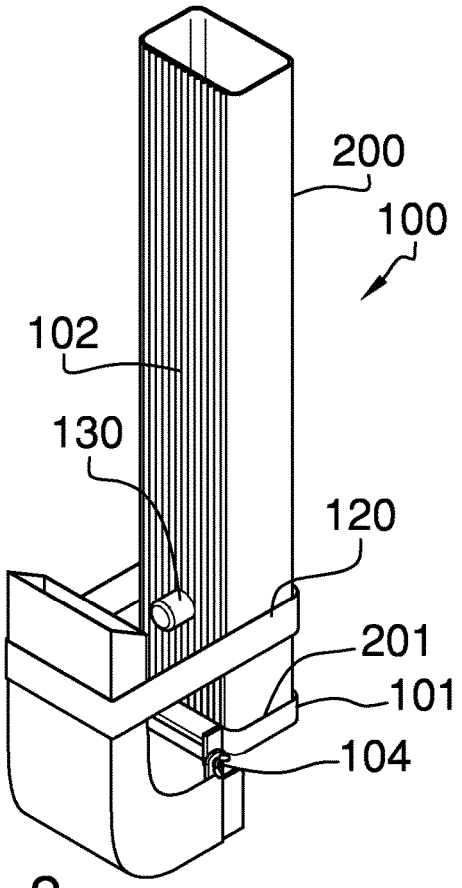
FIG. 2 is a second, perspective view of an embodiment of the disclosure.
Figure 3:
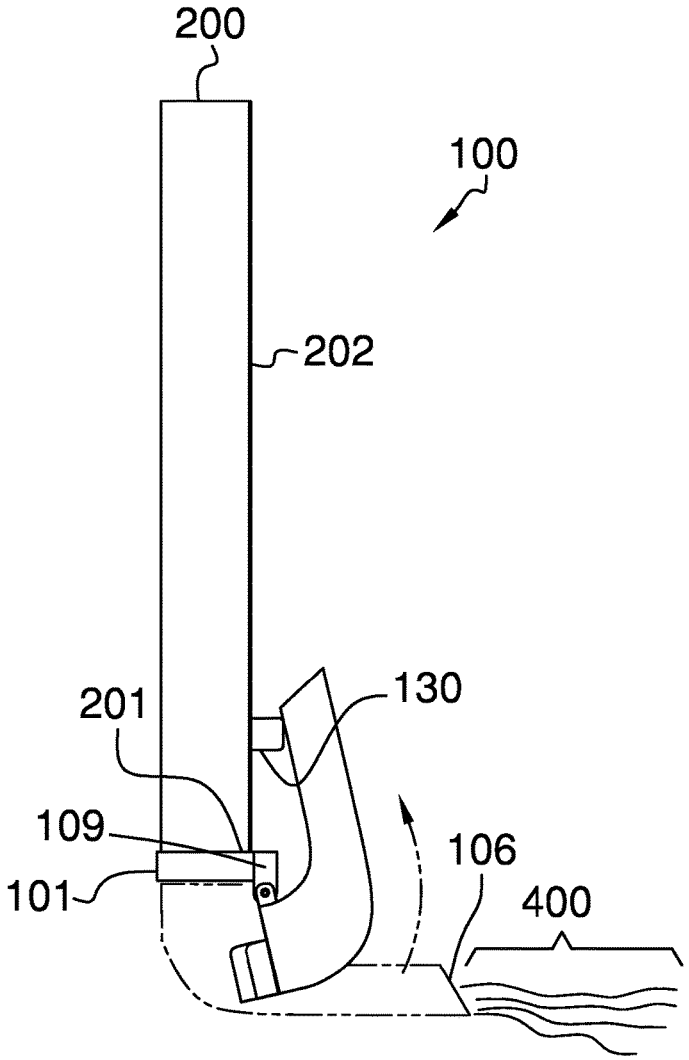
FIG. 3 is a side view of an embodiment of the disclosure.
Figure 4:
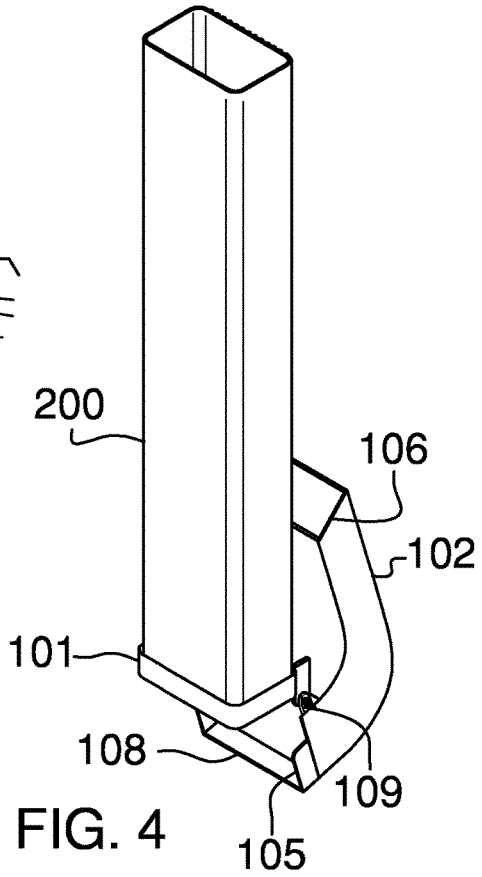
FIG. 4 is a rear, perspective view of an embodiment of the disclosure.
Figure 5:
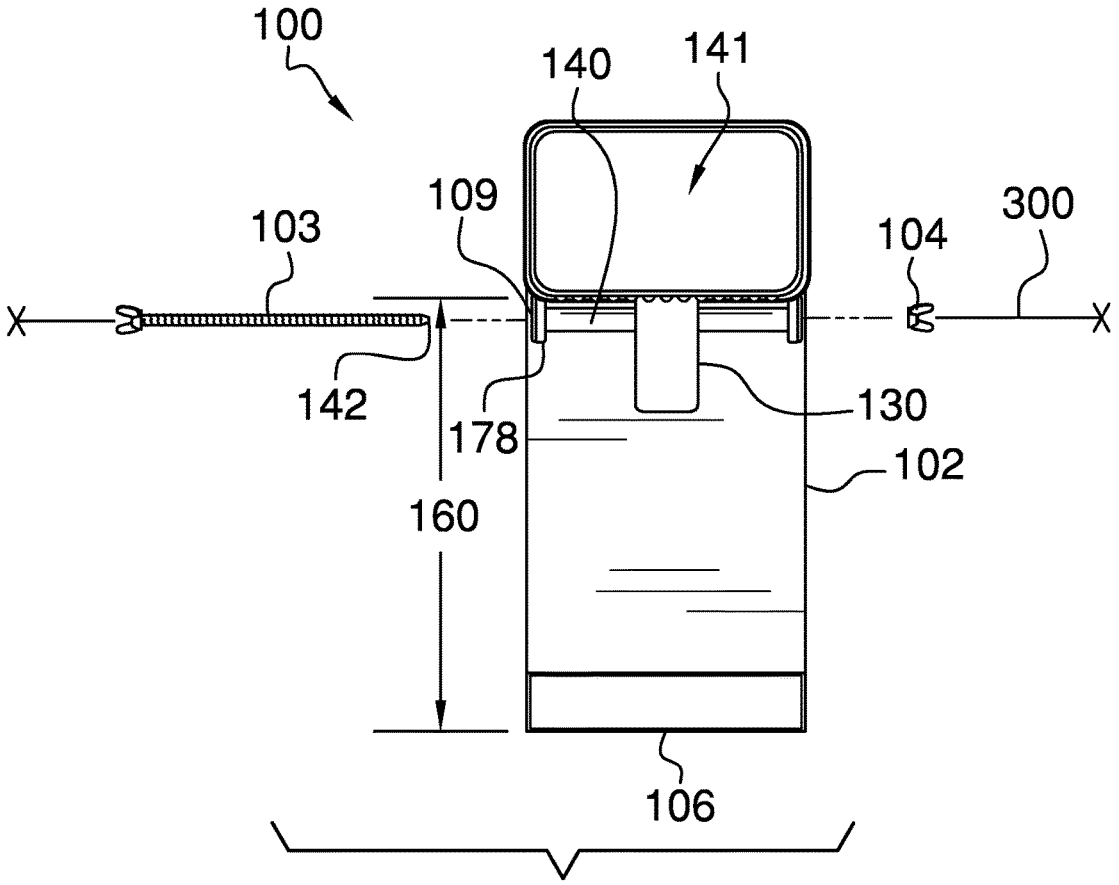
FIG. 5 is a top view of an embodiment of the disclosure.

Detailed reference will now be made to a first potential embodiment of the disclosure, which is illustrated in FIGS. 1 through 5. The hinged chute and connector for a downspout 100 (hereinafter invention) includes a connector 101 and a hinged chute 102. The connector 101 is adapted to attach onto a bottom end 201 of a downspout 200. Moreover, the connector 101 is rigidly affixed over the exterior of the downspout 200. The connector 101 is not able to move with respect to the downspout 200.

The connector 101 is attached to the hinged chute 102 via a rod 103 and a wing nut 104. The hinged chute 102 is able to rotate with respect to a horizontal axis 300. Moreover, the hinged chute 102 rotates from a closed position (see FIG. 1) to an in-use position (see FIG. 2). The hinged chute 102 is further defined with a chute inlet 105 and a chute outlet 106. The chute inlet 105 is able to connect with the connector 101 when the hinged chute 102. In the in-use position; whereas the chute inlet 105 becomes disconnected with the connector 101 when the hinged chute 102 is in the closed position.

The invention 100 includes a strap 120 that is used to support the hinged chute 102 in the closed position. The strap 120 is adapted to encircle a portion of the downspout 200 and the hinged chute 102 collectively. Moreover, the strap 120 may be made of a flexible material in order to flex during manipulation. The downspout 200 may be retrofitted with a stop member 130 that is affixed to a forward surface 202 of the downspout 200. The stop member 130 is able to help support the hinged chute 102 when in the closed position, and also to prevent any denting of the downspout 200 from repeated rotations of the hinged chute 102 there from.

When in use, the chute outlet 106 dispenses rainwater 400 that is transferred to the invention 100 via the downspout 200. The hinged chute 102 is of curved construction such that the chute inlet 105 is perpendicular with respect to the chute outlet 106. The chute outlet 106 is extended out a chute distance 160 away from the front surface 202 of the downspout 200. The chute distance 160 shall be no less than 6 inches, but not greater than 5 feet.

The chute inlet 105 includes a collar member 108 that extends across multiple edges of the chute inlet 105. Moreover, the collar member 108 forms a watertight seal with the bottom end 201 of the downspout 200. A pair of hinge armatures 109 is provided adjacent the collar member 108 of the hinged chute 102. The hinge armatures 109 are provided on opposing sides of the hinged chute 102, and connect with the rod 103 and the wing nut 104 in order to hingedly attach the hinged chute 102 to the connector 101.

The connector 101 is further defined with an interior 141. The connector 101 is further defined with a front connector surface 177 that include a pair of connector armatures 178 that extend outwardly there from. A hinge cylinder 140 extends across the pair of connector armatures 178 of the connector 101. The hinge cylinder 140 of the connector 101 and the pair of hinge armatures 109 of the hinged chute 102 enable the rod 103 to extend there across. The pair of connector armatures 178 interface with the pair of hinge armatures 109 to provide a more-secure connection there between. The wing nut 104 attaches onto a rod distal end 142 of the rod 103 in order to secure the hinged chute 102 to the connector 101.

The connector 101 and the hinged chute 102 may be made of a material consistent with the construction of the downspout 200, and current gutter construction. The connector 101 and the hinged chute 102 may be made of a sheet metal, a plastic, or carbon fiber composite.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hinged chute and connector for a downspout comprising:

a connector that is adapted to be attached onto a downspout;

wherein a hinged chute is rotatably attached to the connector;

wherein rainwater dispensed via the downspout is channeled through the connector and out the hinged chute;

wherein the connector is adapted to attach onto a bottom end of the downspout;

wherein the connector is rigidly affixed over the exterior of the downspout;

wherein the connector is attached to the hinged chute via a rod and a wing nut;

wherein the hinged chute is able to rotate with respect to a horizontal axis;

wherein the hinged chute rotates from a closed position to an in-use position;

wherein the hinged chute is further defined with a chute inlet and a chute outlet;

wherein the chute inlet is able to connect with the connector when the hinged chute is in the in-use position;

wherein the chute inlet becomes disconnected with the connector when the hinged chute is in the closed position;

wherein a strap is used to support the hinged chute in the closed position;

wherein the strap is adapted to encircle a portion of the downspout and the hinged chute collectively;

wherein a stop member is adapted to be secured to a forward surface of the downspout in order to protect the downspout from denting associated with the hinged chute;

wherein the hinged chute is of curved construction such that the chute inlet is perpendicular with respect to the chute outlet.

2. The hinged chute and connector for a downspout according to claim 1 wherein the chute outlet is extended out a chute distance away from the front surface of the downspout.

3. The hinged chute and connector for a downspout according to claim 2 wherein the chute distance is no less than 6 inches, but not greater than 5 feet.

4. The hinged chute and connector for a downspout according to claim 3 wherein the chute inlet includes a collar member that extends across multiple edges of the chute inlet; wherein the collar member forms a watertight seal with the connector.

5. The hinged chute and connector for a downspout according to claim 4 wherein a pair of hinge armatures is provided adjacent the collar member of the hinged chute; wherein the hinge armatures are provided on opposing sides of the hinged chute, and connect with the rod and the wing nut in order to hingedly attach the hinged chute to the connector.

6. The hinged chute and connector for a downspout according to claim 5 wherein the connector is further defined with an interior and a front connector surface.

7. The hinged chute and connector for a downspout according to claim 6 wherein a pair of connector armatures extend outwardly from the front connector surface.

8. The hinged chute and connector for a downspout according to claim 7 wherein a hinge cylinder extends across the pair of connector armatures of the connector; wherein the hinge cylinder of the connector and the pair of hinge armatures of the hinged chute enable the rod to extend there across.

9. The hinged chute and connector for a downspout according to claim 8 wherein the pair of connector armatures interface with the pair of hinge armatures to provide a secure connection there between.

10. The hinged chute and connector for a downspout according to claim 9 wherein the wing nut attaches onto a rod distal end of the rod in order to secure the hinged chute to the connector.

* * * * *